US006260526B1

(12) United States Patent
Kobayashi

(10) Patent No.: US 6,260,526 B1
(45) Date of Patent: Jul. 17, 2001

(54) VALVE MOVEMENT CONTROL SYSTEM OF AN INTERNAL COMBUSTION ENGINE

(75) Inventor: Toshiki Kobayashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/627,156

(22) Filed: Jul. 27, 2000

(30) Foreign Application Priority Data

Dec. 13, 1999 (JP) ..... 11-353567

(51) Int. Cl.[7] ..... F01L 1/344
(52) U.S. Cl. ..... 123/90.17; 123/90.34
(58) Field of Search ..... 123/90.15, 90.17, 123/90.31, 90.33, 90.34, 90.38

(56) References Cited

U.S. PATENT DOCUMENTS 5,794,579 * 8/1998 Moriya ..... 123/90.17
5,803,031 * 9/1998 Moriya ..... 123/90.17
6,026,772 * 2/2000 Shirabe ..... 123/90.17

FOREIGN PATENT DOCUMENTS 11-173119 6/1999 (JP) .

* cited by examiner

*Primary Examiner*—Weilun Lo
(74) *Attorney, Agent, or Firm*—Arent Fox Kintner Plotkin & Kahn, PLLC

(57) ABSTRACT

In a valve movement control system of an internal combustion engine, a hydraulic operational characteristic variable mechanism with no operational lag or a shortened operational lag on re-starting of the engine is provided. The valve movement control system comprises a camshaft having a cam journal supported for rotation by a support member, a hydraulic operational characteristic variable mechanism provided on the camshaft, an oil pressure control valve, and a control oil passage for supplying operating oil to the operational characteristic variable mechanism through a plurality of members including the camshaft and the support member. An operating oil reserve chamber is provided above the cam journal for supplementing operating oil flowing out through a minute gap between the cam journal and the support member when the engine is stopped.

2 Claims, 6 Drawing Sheets

VALVE MOVEMENT CONTROL SYSTEM OF AN INTERNAL COMBUSTION ENGINE

BACKGROUND OF THE INVENTION

The present invention relates to a valve movement control system of an internal combustion engine having a hydraulic operational characteristic variable mechanism for altering operational characteristic such as opening-closing time of an engine valve, including a hydraulic phase variable mechanism for altering opening-closing time of an engine valve such as a suction valve or an exhaust valve.

Hitherto, there has been known a valve movement control system of an internal combustion engine having a hydraulic phase variable mechanism which alters opening-closing time of a suction valve or an exhaust valve by altering relative phase of a camshaft to a crankshaft in accordance with operational state of the engine, in order to improve engine output and fuel consumption.

For example, in a valve timing control system of an internal combustion engine disclosed in Japanese Laid-Open Patent Publication Hei 11-173119, a valve timing adjusting mechanism provided on an end of a suction side camshaft has a rotor housing drivingly connected to a crankshaft and a vane rotor having a plurality of vanes drivingly connected to the suction side camshaft. On both sides of the each vane are formed a retard chamber and an advance chamber respectively, and charging and discharging of operating oil to the retard chamber and the advance chamber are controlled by a OCV (oil control valve) operated based on operational state of the engine, so that relative phase of the suction side camshaft to the crankshaft is altered to adjust opening-closing timing of the suction valve.

The operating oil supplied by an oil pump driven by the engine and controlled by the OCV is charged to or discharged from the retard chamber and the advance chamber, passing through a head oil passage provided in a cylinder head, an annular oil groove provided on an inner peripheral surface of a journal bearing formed by the cylinder head and a bearing cap for supporting the camshaft, and an oil passage provided in the camshaft.

Generally, a minute gap exists between the camshaft and the journal bearing. Therefore, in the prior art, when the engine is stopped to stop the oil pump and the operating oil is not supplied to the oil passage, the operating oil in the oil passage provided in the suction side camshaft and the operating oil in the retard chamber and the advance chamber flow out through the minute gap as time goes by, though by very small amount, so that the operating oil in the oil passage, the retard chamber and the advance chamber has a tendency to decrease.

When the engine is started from the state that operating oil in the oil passage, the retard chamber and the advance chamber is reduced, some waiting time is required after the engine is started to drive the oil pump, for filling the oil passage and the retard chamber or the advance chamber with the operating oil (whether any one chamber or both chambers must be filled with the operating oil depends on setting of the valve timing adjusting mechanism during the engine is stopped), and enabling the valve timing adjusting mechanism to operate. However, a time required for the engine to reach a loaded operation necessitating valve timing adjustment is relatively long in general and the oil passage and the retard chamber or the advance chamber can be filled with the operating oil during the time, therefore the above-mentioned required waiting time does not came into question.

However, on re-starting of the engine when the engine is started from a state that warming-up is completed, the time required for the engine to reach the loaded operation is relatively short in general, so that sometimes the oil passage and the retard chamber or the advance chamber are not filled with the operating oil before the engine reaches the loaded operation. In this case, the valve timing adjusting mechanism can not operate until the oil passage and the retard chamber or the advance chamber are filled with the operating oil. This late operation causes lowering of the engine output, and lowering of drive-ability in case of an engine mounted on a vehicle.

SUMMARY OF THE INVENTION

The present invention has been accomplished in view of the foregoing, and an object of the invention is to provide a hydraulic operational characteristic variable mechanism with no operational lag or a shortened operational lag on re-starting of the engine. Another object of the invention is to provide a structure facilitating preparation of a operating oil reserve chamber.

The present invention provides a valve movement control system of an internal combustion engine, comprising a camshaft driven by a crankshaft having a cam journal supported for rotation by a support member; a hydraulic operational characteristic variable mechanism provided on the camshaft for altering operational characteristic of an engine valve driven by a cam of the camshaft; an operating oil passage extending from an oil pressure supply source driven by the internal combustion engine to the operational characteristic variable mechanism passing through a plurality of members including at least the camshaft and the support member; and an oil pressure control valve provided in the operating oil passage for controlling pressure of operating oil sent to the operating characteristic variable mechanism. The operating oil passage forms a control oil passage having a first oil passage and a second oil passage between an operation chamber of the operational variable mechanism and the oil pressure control valve, the first oil passage provided in the camshaft has an end communicating with the operation chamber and another end communicating with the second oil passage formed between the cam journal and the support member. In such a valve movement control system, an operating oil reserve chamber communicating with the control oil passage is provided above the cam journal.

According to this invention, since the operating oil reserve chamber is provided above the cam journal and there is a greater quantity of the operating oil above the minute gap between the cam journal and the support member in comparison with the prior art, even if the operating oil flows out through the minute gap during the engine is stopped, the oil pressure supply source is not driven and the operating oil is not supplied to the operation chamber of the operational characteristic variable mechanism and the control oil passage, a time required for the operating oil in the operation chamber and the first and second oil passages to decrease to the same extent as the prior art can be prolonged As the result, a possibility that the operation chamber and the first and second oil passages are filled with the operating oil or relatively large quantity of the operating oil remains in the operation chamber and the first and second oil passages upon re-starting such as starting after idle stop can be raised, by setting a quantity of the operating oil reserved in the operating oil reserve chamber suitably. Therefore, there is no operation lag or operation lag time is shortened, so that the engine can be operated by the engine valve of a desired operational characteristic relatively soon and output lowering caused by non-operation of the operational characteristic variable mechanism can be prevented with a high possibility.

In such a valve movement control system of an internal combustion engine, the support member may comprise a lower member and a cam holder disposed above the lower member, and the operating oil reserve chamber may be provided in the cam holder and may communicate with the second oil passage within the cam holder.

According to this valve movement control system, the operating oil reserve chamber can be provided utilizing the cam holder disposed above the lower member to support the cam journal from the upside. Therefore, there is no necessity to dispose an additional member for forming the operating oil reserve chamber above the cam journal. Moreover, it is possible to provide an operating oil reserve chamber in a customary engine having a phase variable mechanism easily only by changing the cam holder and without changing arrangement of parts around the camshaft.

Since the second oil passage constituting the control oil passage is provided in the cam holder constituting the support member, the operating oil reserve chamber can be connected with the control oil passage compactly and easily, without necessitating an additional connection passage, by connecting the operating oil reserve chamber with the second oil passage within the cam holder.

DETAILED DESCRIPTION OF THE PREFERRED EMBODIMENT

Hereinafter, a preferred embodiment of the present invention will be described with reference to FIGS. 1 to 6.

Figure 1:
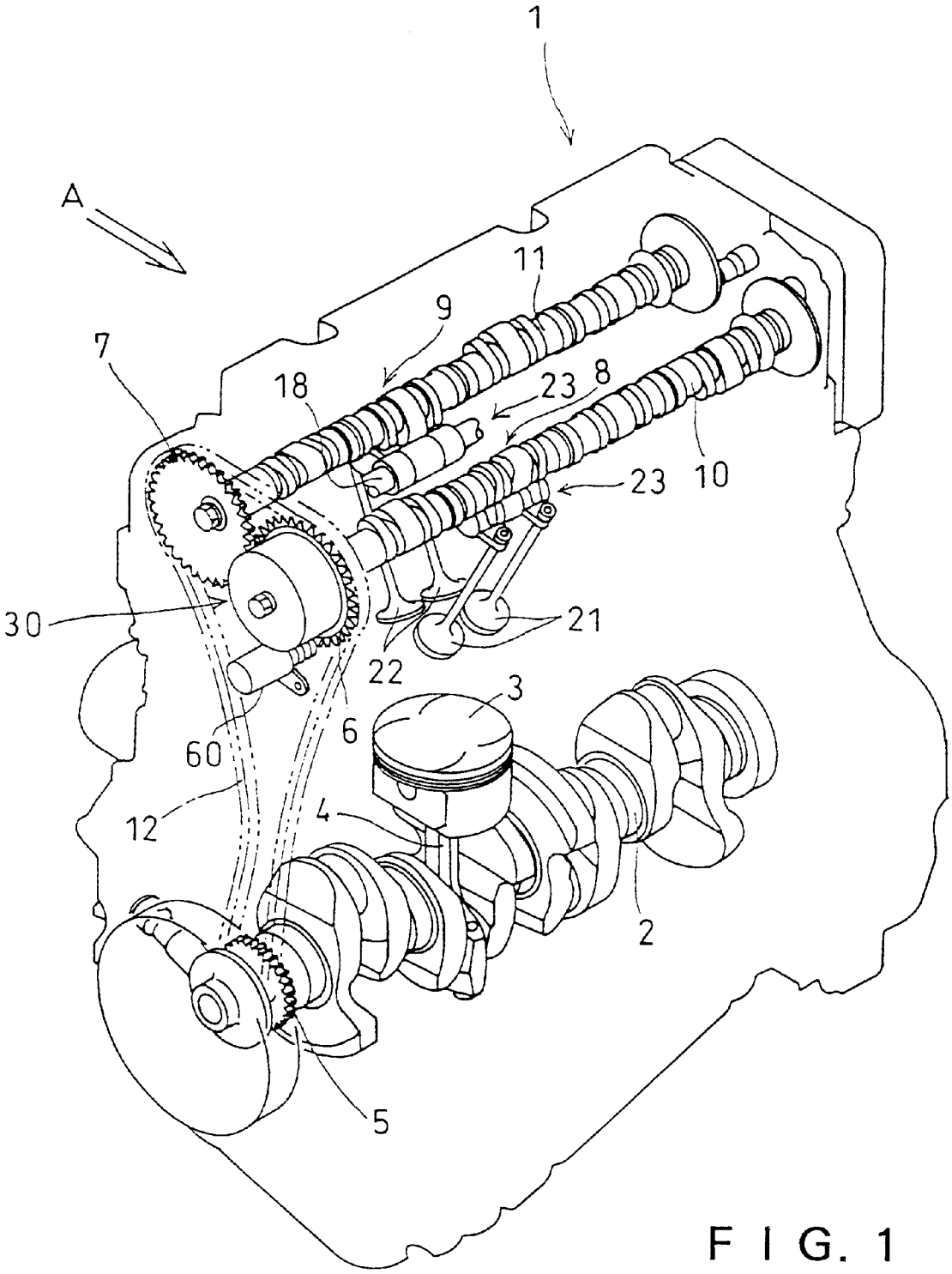
FIG. 1 is a schematic whole view of an internal combustion engine applied with the present invention.
Figure 2:
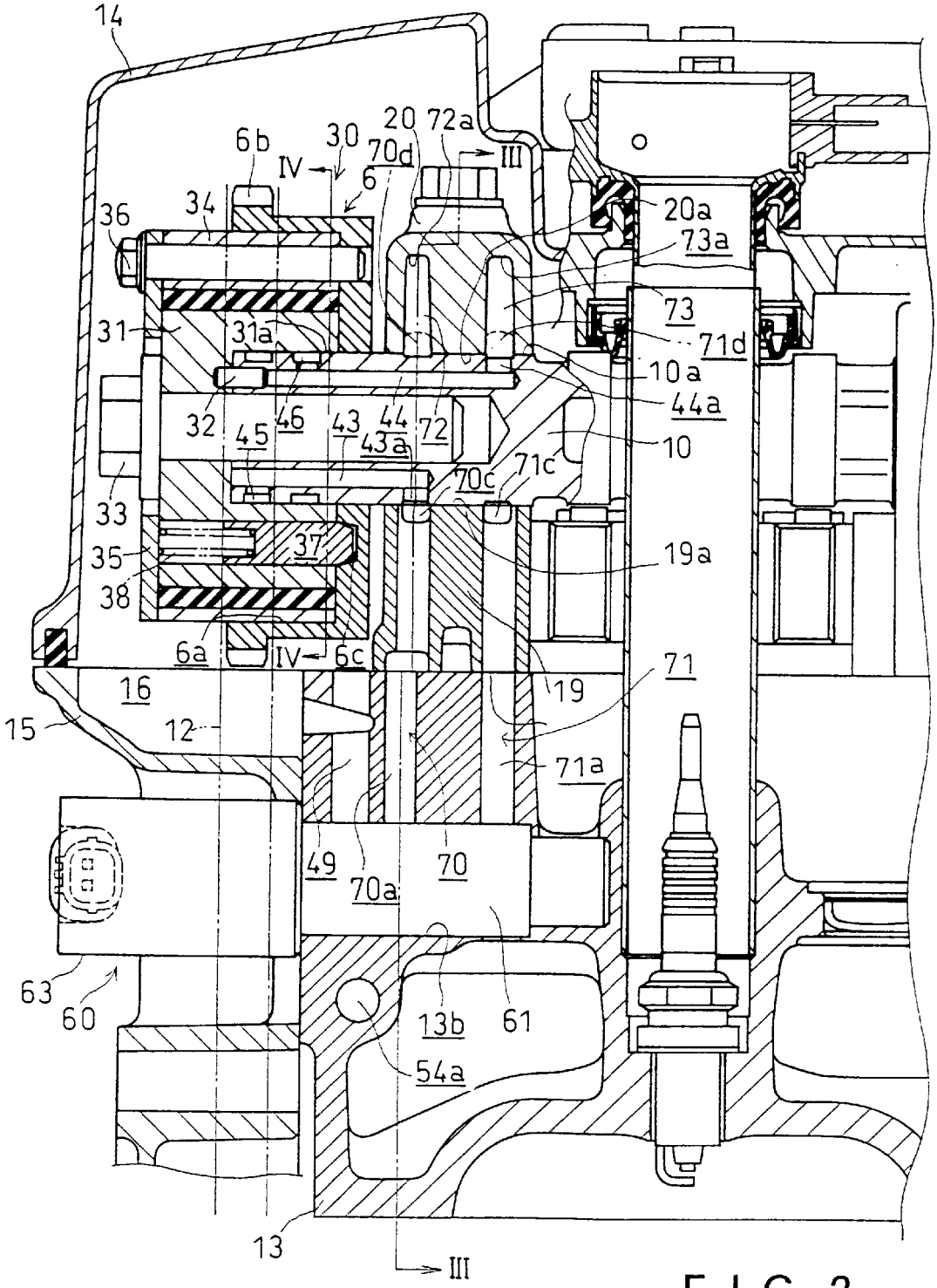
FIG. 2 is a sectional front view of FIG. 1.

In this embodiment, the internal combustion engine 1 is a spark-ignition DOHC type four cylinders internal combustion engine mounted on a vehicle with a crankshaft directed in right-left direction of the vehicle. As shown in FIG. 1, a piston 3 fitted slidingly in a bore of a cylinder is connected to the crankshaft 2 by means of a connecting rod 4. A drive sprocket 5 is provided at a right end (left end in FIG. 1) portion of the crankshaft 2 and a suction cam sprocket 6 and an exhaust cam sprocket 7 are provided at respective right end portions of a suction camshaft 10 and an exhaust camshaft 7 which are disposed in parallel with each other. The suction camshaft 10 and the exhaust camshaft 7 are provided with a suction cam 8 and an exhaust cam 9 respectively. A timing chain 12 is wound round the sprockets 5, 6, 7 so that camshafts 10, 11 are driven by the crankshaft 2 so as to rotate with a sped reduction ratio of 1/2. As shown in FIG. 2, the sprockets 5, 6, 7 and the timing chain 12 are housed in a chain chamber 16 formed by a cylinder head cover 14, an oil pan and a chain cover 15 attached to right sides of a cylinder head 13 and a cylinder block.

In this description, "front", "rear", "right" and "left" are expressed with respect to one who looks toward the front of the vehicle with the engine mounted riding on the vehicle. In FIG. 1, the arrow A shows traveling direction of the vehicle. And upside and downside mean those with respect to the internal combustion engine 1 mounted on the vehicle.

Figure 3:
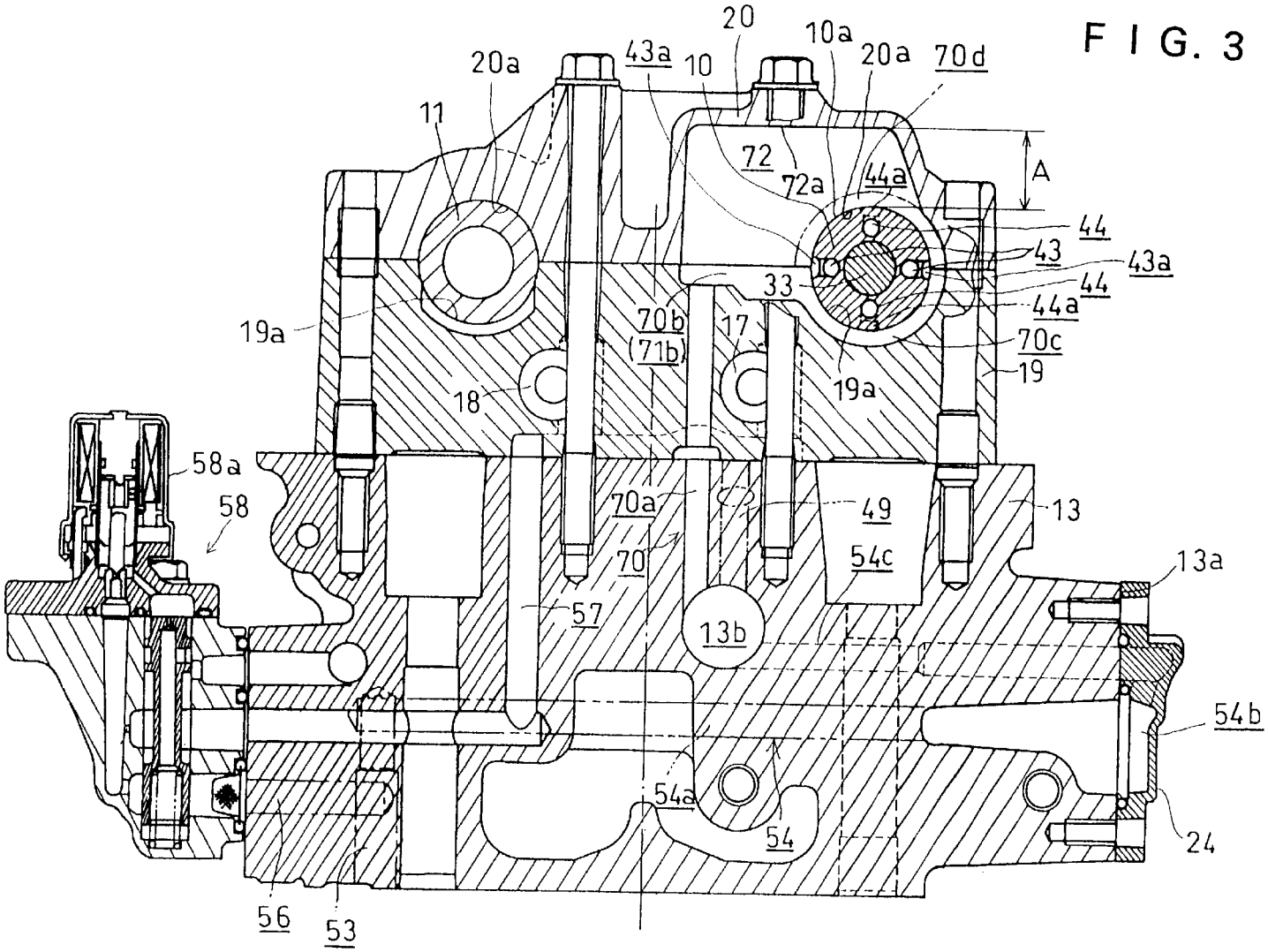
FIG. 3 is a sectional view taken along the line III—III of FIG. 2.

Referring to FIG. 3 too, a plurality of rocker shaft holders is put on the cylinder head 13 at both ends of the row of cylinders and between the neighboring cylinders. In each of the rocker shaft holders is fixed a suction rocker shaft 17 and an exhaust rocker shaft 18 which extend in front-rear direction in parallel with each other and support for rocking motion a suction rocker arm and an exhaust rocker arm respectively. On the each rocker shaft holder is put a corresponding cam holder. In the drawings, a rocker shaft holder 19 at the right end and a cam holder 20 at the right end are shown. Each pair of the rocker shaft holder and the cam holder is fixed to the cylinder head 13 by bolts.

In order to support the suction and exhaust camshafts 10, 11 so as to rotate relatively to the cylinder head 13, cam journals of the both camshafts 10, 11 are supported in circular holes each having a lower support surface formed by a semi-cylindrical hollow on an upper surface of the rocker shaft holder and an upper support surface formed by a semi-cylindrical hollow on a lower surface of the cam holder. In the drawings, cam journals 10*a*, 11*a* at the right end, a lower support surface 19*a* of a rocker shaft holder 19 at the right end and an upper support surface 20*a* of a cam holder 20 at the right end are shown. The rocker shaft holders and the cam holders constitute support members for the cam journals, and the rocker shaft holders constitute lower members of the support members.

Each cylinder has a pair of suction valves (engine valves) 21 driven by the suction rocker arm and a pair of exhaust valves (engine valves) 22 driven by the exhaust rocker arm. Between the suction camshaft 10 and the suction valve 21 and between the exhaust camshaft 11 and the exhaust valve 22, there are provided respective changing mechanisms 23 which change lift and opening time of the valves in accordance with engine rotational speed.

On a right end portion of the suction camshaft 10 having the suction cam sprocket 6 is provided a phase variable mechanism 30, which is a hydraulic operational characteristic variable mechanism for altering relative phase of the suction camshaft 10 or the suction cam to the crankshaft 2 to advance or retard opening-closing time of the suction valve 21.

Figure 4:
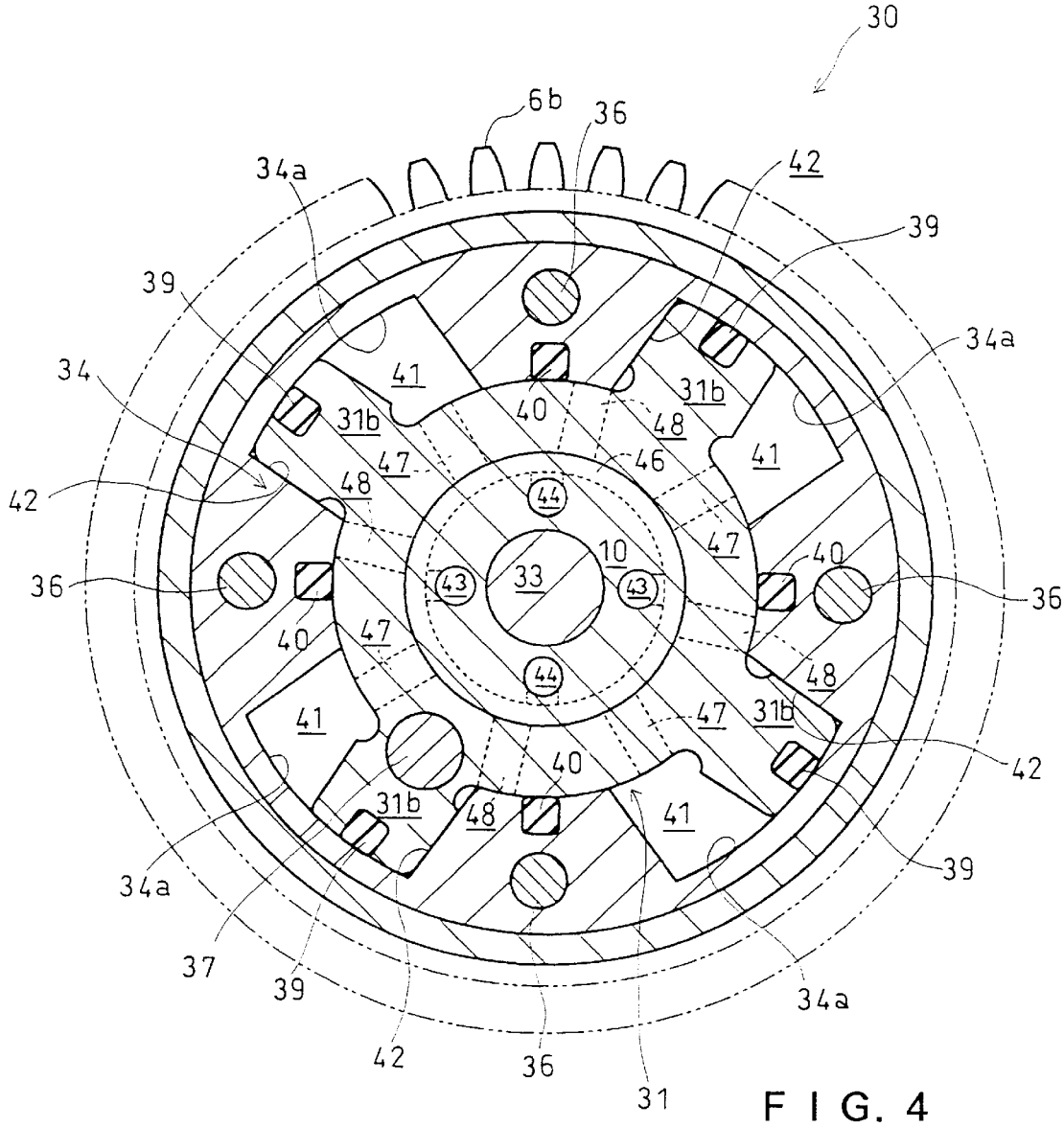
FIG. 4 is a sectional view taken along the line IV—IV of FIG. 2.

The construction of the phase variable mechanism 30 provided on the right end portion of the suction camshaft 10 will be described with reference to FIGS. 2 and 4. In FIG. 2, a part of the suction camshaft 10 is shown by a section other than that of the other part for the convenience of the description.

A cylindrical boss member 31 is connected to the suction camshaft 10 by a pin 32 and a bolt 33 in a state that a support hole 31*a* formed at the center of the boss member 31 is coaxially fitted to the right end portion of the suction camshaft 10. The boss member 31 constitutes a camshaft side member drivingly connected to the suction camshaft 10 so as to rotate as one body.

The suction cam sprocket 6 is formed in a cup-like shape having a circular hollow 6*a* and sprocket teeth 6*b* are formed on a periphery of the sprocket 6. An annular housing 34 fitted in the hollow 6*a* of the suction cam sprocket 6 and a plate 35 piled on the housing 34 axially are connected to the suction cam sprocket 6 by four bolts 6 penetrating them so as to constitute a crankshaft side member drivingly connected to the camshaft 2 through the timing chain 12.

The boss member 31 is enclosed in a space surrounded by the housing 34 and the plate 35 so as to rotate relatively to the housing 34. The boss member 31 has a pin hole penetrating it axially in which a lock pin 37 is fitted so as to slide. The lock pin 37 is forced toward a lock hole 6*c* formed in the suction cam sprocket 6 by a spring 38 inserted between the lock pin 37 and the plate 35 in a compressed state.

Within the housing 34, four fan-shaped hollows 34*a* are formed around axis of the suction camshaft 10 at intervals of 90 degrees, and four vanes 31*b* radially projecting from an outer periphery of the boss member 31 are fitted in the respective hollows 34*a* so as to rotate about the axis of the boss member 31 by 30 degrees relatively to the hollows 34*a*. Four seal members 39 provided at respective tip ends of the vanes 31*b* make sliding contact with bottom walls of the hollows 34*a*, and four seal members 40 provided on an inner peripheral surface of the housing 34 make sliding contact with an outer peripheral surface of the boss member 31, so that a retard chamber 41 and an advance chamber 42, which are operation chambers of the phase variable mechanism 30, are formed on both sides of each vane 31*b* respectively.

In a right end portion of the suction camshaft 10 are formed a pair of oil passages 43 and a pair of oil passages 44 in parallel with axis of the suction camshaft 10. These oil passages 43, 44 have respective openings 43*a*, 44*a* on an outer periphery of the cam journal 10*a* at the right end. The oil passages 43 communicate with the retard chambers 41 through oil passages 45 including annular grooves formed on an outer periphery of the suction camshaft 10 and oil passages 47 radially penetrating the boss member 31, and the oil passages 44 communicate with the advance chambers 42 through oil passages 46 including annular grooves formed on an outer periphery of the suction camshaft 10 and oil passages 48 radially penetrating the boss member 31. The lock hole 6*c* for fitting to the lock pin 37 communicates with any one of the advance chambers 42 through a not shown oil passage.

When the advance chamber 42 is not supplied with the operating oil, the lock pin 37 is fitted in the lock hole 6*c* of the suction cam sprocket 6 by force of the spring 38, so that the suction camshaft 10 is locked in a most retarded state that the suction camshaft 10 is rotated counterclockwise relatively to the suction cam sprocket 6. Then, if the advance chamber 42 is supplied with the operating oil to raise oil pressure in the chamber 42 gradually, the lock pin 37 escapes from the lock hole 6*c* by the oil pressure in the advance chamber 42 against the spring 38, the suction camshaft 10 rotates clockwise relatively to the suction cam sprocket 6 by difference of pressures acting on both sides of the vane 31, relative phase of the suction camshaft 10 to the crankshaft 2 alters in an advancing direction, phase of the suction cam 8 relative to the crankshaft 2 also advances, and opening time and closing time of the suction valve 21 change toward advancing side. Thus, opening-closing time of the suction valve 21 can be changed continuously by controlling oil pressure in the retard chamber 41 and the advance chamber 42.

Figure 5:
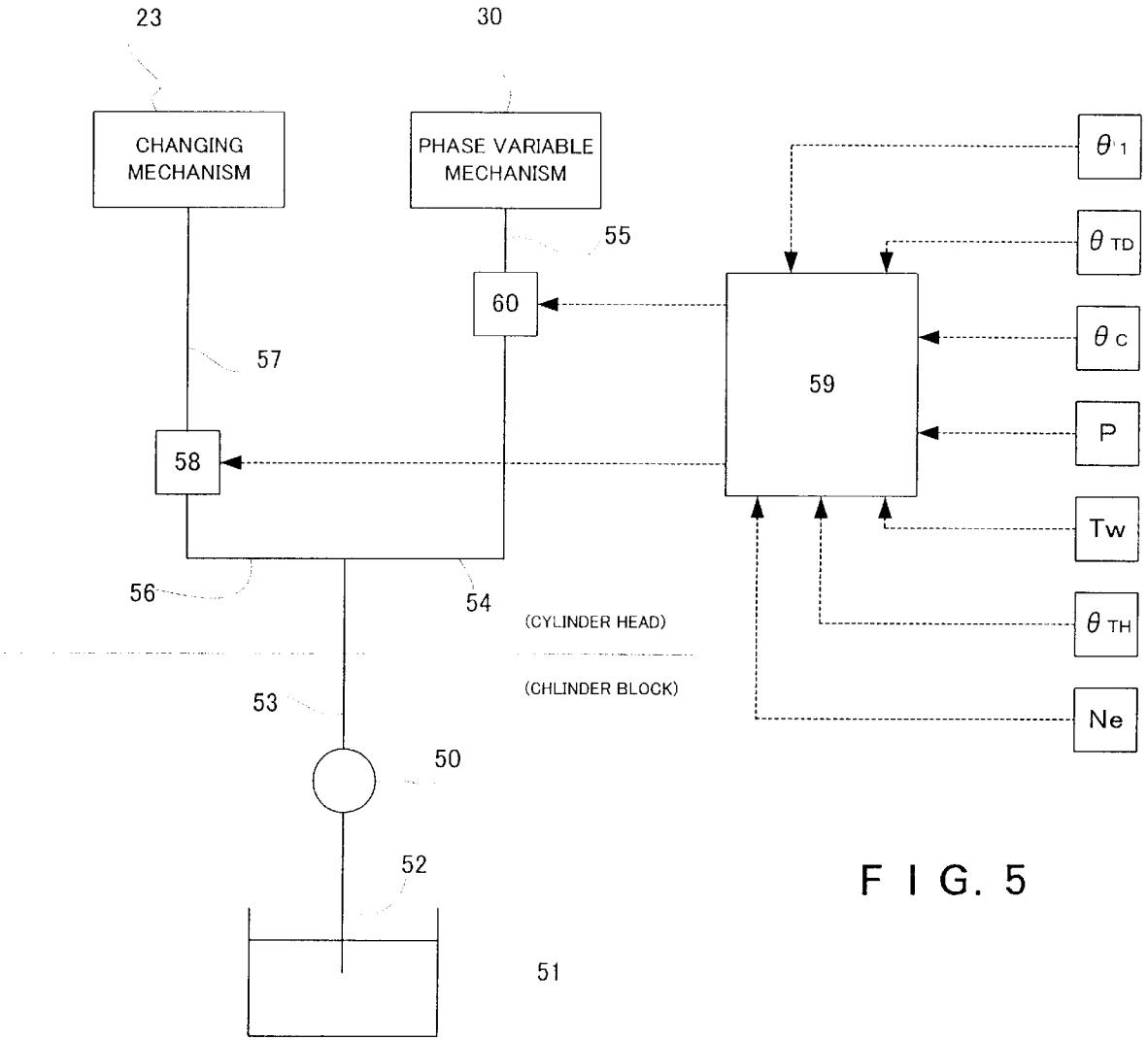
FIG. 5 is a schematic view of oil passages of the valve movement control system.

Next, operating oil passages of the valve movement control system will be described with reference to FIG. 5.

Oil pumped up by an oil pump 50 driven by the crankshaft 2 from an oil pan 51 through an oil passage 52 is discharged as lubricant oil of neighborhood of the crankshaft 2 and the valve movement mechanism, and as operating oil of the phase variable mechanism 30 and the changing mechanism 23.

The operating oil passage through which the oil discharged from the oil pump 50 passes, includes a supply oil passage leading to the oil pressure control valve 60 and the oil pressure changing valve 58 from the oil pump 50, a control oil passage 55 and a changing oil passage 57. And the supply oil passage includes a common supply oil passage 53, a supply oil passage for phase 54 and a supply oil passage for change 56.

From the common supply oil passage 13 formed through the cylinder block and the cylinder head 13 branches the supply oil passage for phase 54 leading to the oil pressure control valve 60 which controls oil pressure of the retard chamber 41 and the advance chamber 42. To the oil pressure control valve 60 is connected the control oil passage 55 leading to the phase variable mechanism 30. Further, the supply oil passage for change 56 leading to the oil pressure changing valve 58 is connected to the common supply oil passage 53 branching from the passage 53. To the oil pressure changing valve 58 is connected the changing oil passage 57 leading to the changing mechanism 23.

Signals from various engine operational state detecting means, such as a suction camshaft sensor detecting a rotational position ΘI of the suction camshaft 10, a TDC sensor detecting a top dead center ΘTD of the piston 3 based on an exhaust camshaft sensor detecting a rotational position of the exhaust camshaft 11, a crankshaft sensor detecting a rotational position ΘC of the crankshaft 2, a suction negative pressure sensor detecting suction negative pressure P, a cooling water temperature sensor detecting cooling water temperature TW, a throttle opening degree sensor detecting throttle opening degree ΘTH and a rotational speed sensor detecting rotational speed Ne of the engine 1, are inputted into an electronic control unit 59.

More detailed construction of the oil passages and the oil pressure control valve 60 will be described with reference to FIGS. 2, 3 and 6.

As shown in FIG. 3, the common supply oil passage 53 is formed in the right end portion of the cylinder head 13 extending upward from a contact surface to the cylinder block. The supply oil passage 56 branches from the common supply oil passage 53 at right angles to the passage 56 and communicates with the oil pressure changing valve 58.

The oil pressure changing valve 58 which acts in accordance with instructions from the electronic control unit 59, has a normal-close-type solenoid valve 58*a* and changes pressure of operating oil in the changing oil passage 57 in accordance with engine rotational speed into a low pressure or a high pressure to operate the changing mechanism 23.

The supply oil passage for phase 54 is connected to the common supply oil passage 53 at a downstream position of the supply oil passage for change 56. The supply oil passage 54 includes an oil passage section 54*a* which extends from the common supply oil passage 53 at right angles and opens on an attachment surface provided on a front surface 13*a* of the cylinder head 13, an oil passage section 54*b* formed in a cover 24 attached on the attachment surface, and an oil passage section 54*c* extending in parallel with the oil passage section 54*a* to reach the oil pressure control valve 60.

The oil pressure control valve 60, which is inserted in an insertion hole 13*b* drilled from a right end surface of the cylinder head 13 at inside of the looped timing chain 12, comprises a cylindrical sleeve 61, a spool 62 fitted for sliding in the sleeve 61, a duty solenoid 63 fixed to the sleeve 61 for driving the spool 62, and a spring 64 forcing the spool 62 toward the duty solenoid 63. Electric current to be supplied to the duty solenoid 63 is duty controlled by ON duty in accordance with instructions from the electronic control unit 59 so that axial position of the spool 62 is changed continuously against the spring 64.

The sleeve 61 has an inlet port 61*a* positioned at the center communicating with the supply oil passage for phase 54, a retard port 61*b* and an advance port 61*c* provided on both sides of the inlet port 61*a* respectively, and drain ports 61*d*, 61*e* formed outside of the ports 61*b*, 61*c* respectively. On the one hand, the spool 62 has a central groove 62*a*, lands 62*b*, 62*c* provided on both sides of the groove 62*a* respectively, and grooves 62*d*, 62*e* provided outside of the lands 62*b*, 62*c* respectively. A tip end portion of the sleeve 61 provided with the drain port 61*e* penetrates the insertion hole 13*b* to project into a space formed in the cylinder head 13. The drain port 61*d* communicates with the drain oil passage 49.

Figure 6:
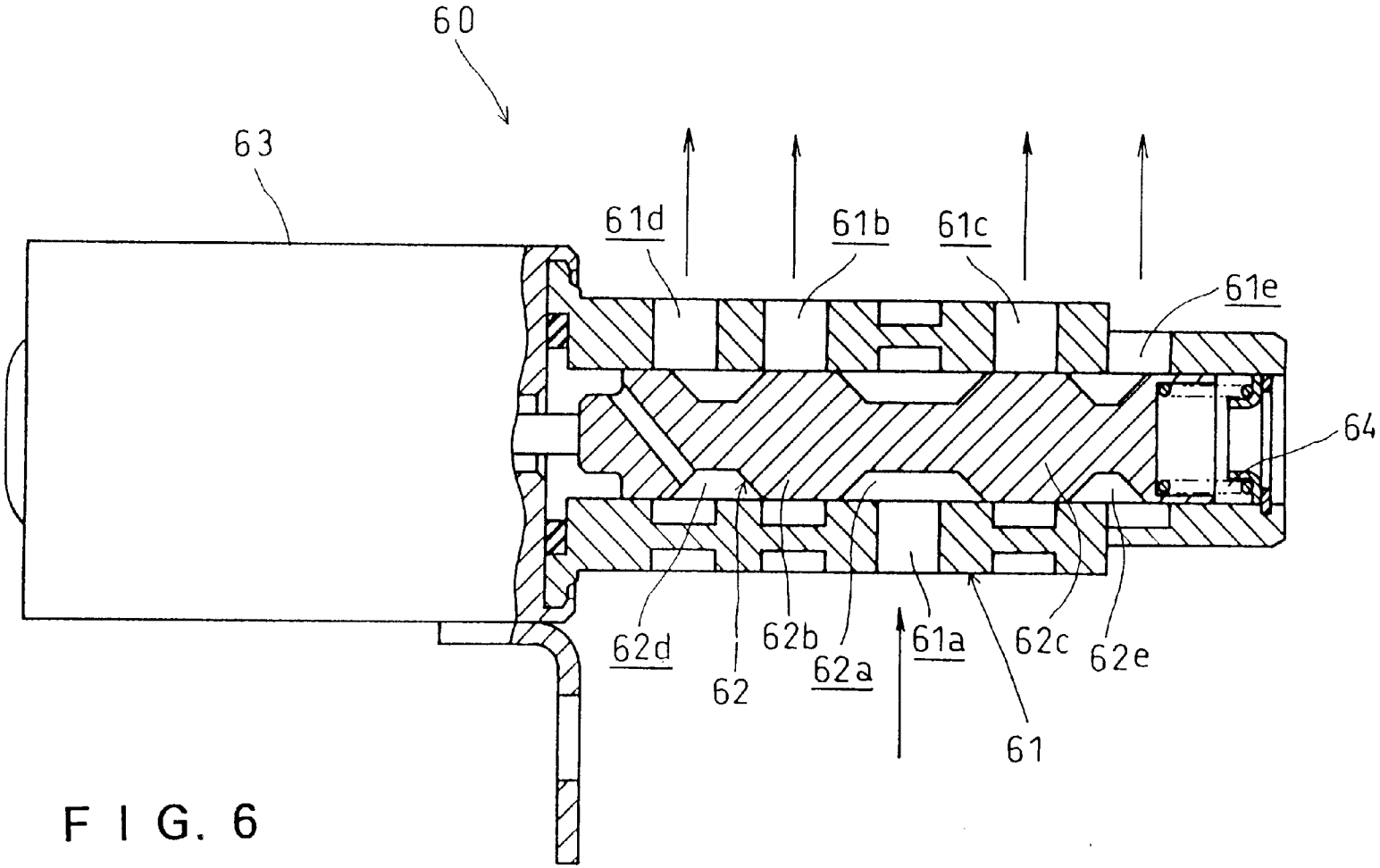
FIG. 6 is a partial sectional view of an oil pressure control valve.

In FIG. 6, the spool 62 is positioned at a neutral position and duty ratio of the duty solenoid 63 is set at 50% for example. If the duty ratio is increased, the spool 62 is moved to the right in FIG. 6 from the neutral position against the spring 64, the inlet port 61*a* communicates with the advance port 61 through the groove 62*a*, and the retard port 61*b* communicates with the drain port 61*d* through the groove 62*d*. As the result, the advance chamber 42 of the phase variable mechanism 30 is supplied with operating oil, the suction camshaft 10 rotates clockwise relatively to the suction cam sprocket 6 in FIG. 4, and phase of the suction camshaft 10 changes continuously toward advancing side. Then, duty ratio of the duty solenoid 63 is set at 50% when a target relative phase is obtained. The spool 62 is held again at the neutral position where the inlet port 61*a* is closed between the lands 26*b*, 26*c*, and the retard port 61*b* and the advance port 61*c* are held at positions closed by the lands 62*b*, 62*c* respectively. Thus, the suction cam sprocket 6 and the suction camshaft 10 are integrated to maintain the relative phase constant.

In order to change relative phase of the suction camshaft 10 continuously toward retard side, duty ratio of the duty solenoid 63 is decreased from 50%. In this case, the spool 62 is moved from the neutral position to the left in FIG. 6, the inlet port 61*a* communicates with the retard port 61*b* through the groove 62*a*, the advance port 61*c* communicates with the drain port 61*e* through the groove 62*e*, and the retard chamber 41 of the phase variable mechanism 30 is supplied with operating oil. Then duty ratio of the duty solenoid 63 is set at 50% when a target relative phase is obtained. The spool 62 is held again at the neutral position shown in FIG. 6 to maintain a constant relative phase.

The control oil passage 55 (FIG. 5) includes a retard side control oil passage 70 and an advance side control oil passage 71 as shown in FIGS. 2 and 3. The retard side control oil passage 70 includes an oil passage 70*a* extending upward from the retard port 61*b* within the cylinder head 13 and the rocker shaft holder 19, an oil passage 70*b* formed on a contact surface of the rocker shaft holder 19 to the cam holder 20 to communicate with the oil passage 70*a*, an oil passage 70*c* communicating with the oil passage 70*b* and extending along an outer periphery of the cam journal 10*a* of the suction camshaft 10 which is formed by a semi-annular groove on the lower surface 19*a* of the rocker shaft holder 19, an oil passage 70*d* communicating with the oil passages 70*b*, 70*c* and integrally joined with a retard side operating oil reserve chamber 72 which opens on the upper support surface 20*a* of the cam holder 20 and a contact surface of the cam holder 20 to the rocker shaft holder 19, the aforementioned oil passage 43 communicating with the oil passage 70*d* through the opening 43*a*, and the aforementioned oil passage 45.

On the one hand, the advance side control oil passage 71 includes an oil passage 71*a* extending upward from the advance port 61*c* within the cylinder head 13 and the rocker shaft holder 19, an oil passage 71*b* formed on a contact surface of the rocker shaft holder 19 to the cam holder 20 to communicate with the oil passage 71*a* (FIG. 3), an oil passage 71*c* communicating with the oil passage 71*b* and extending along an outer periphery of the cam journal 10*a* of the suction camshaft 10 which is formed by a semi-annular groove on the lower support surface 19*a* of the rocker shaft holder 19, an oil passage 71*d* communicating with the oil passages 71*b*, 71*c* and integrally joined with an advance side operating oil reserve chamber 73 which opens on the upper support surface 20*a* of the cam holder 20 and a contact surface of the cam holder 20 to the rocker shaft holder 19, the aforementioned oil passage 44 communicating with the oil passage 71*d* through the opening 44*a*, and the aforementioned oil passage 46. The oil passage 71*b* of the advance side control oil passage 71 corresponds to the oil passage 70*b* of the retard side control oil passage 70.

Therefore, the retard side control oil passage 70 and the advance side control oil passage 71 constitute operating oil passages formed through a plurality of members including the cylinder head 13, the rocker shaft holder 19, the cam holder 20 and the suction camshaft 10.

The operating oil reserve chambers 72, 73 are composed of deep cuts formed in the cam holder 20 which include the oil passages 70*d*, 71*d* as a whole. As mentioned above, the oil passages 70*d*, 71*d* are semi-annular oil passages to be formed on the upper support surface 20*a* of the cam holder 20 in order to connect the openings 43*a*, 44*a* of the oil passages 43, 44 formed in the suction camshaft 10 with the oil passages 70*b*, 71*b*. The oil passages 70*d*, 71*d* have the same depth as that of the oil passages 70*c*, 71*c* as shown in FIGS. 2 and 3 by a two-dots-and-dash line. The deep cuts are formed simultaneously with casting of the cam holder 20.

Upper surfaces 72*a*, 73*a* of the operating oil reserve chambers 72, 73 are positioned higher by a predetermined distance A than the cam journal 10*a* (FIG. 3). Further, when the retard chamber 41 and the advance chamber 42 of the phase variable mechanism 30 are in their highest position, height of the uppermost portion of the chambers 41, 42 is the same as height of the upper surfaces 72*a*, 73*a*. Width of the operating oil reserve chambers 72, 73 in the direction of axis of the suction camshaft 10 is the same as that of the oil passages 70*c*, 71*c*. Rear ends of the operating oil reserve chambers 72, 73 are positioned at substantially the same positions as rear ends of the oil passages 70*b*, 71*b* and at the middle of the suction camshaft 10 and the exhaust camshaft 11.

The distant A between the upper surface 72*a* (73*a*) and the uppermost portion of the cam journal 10*a* is decided depending on a volume of an upper part of the operating oil reserve chamber 72 (73) existing above the uppermost portion of the cam journal 10*a*. The volume of the upper part is decided so that even if operating oil flows out through the aforementioned minute gap during a set time set in consideration of a statistically most feasible time elapsing while the engine 1 is once stopped then re-started, the oil passage 43 (44) in the suction camshaft 10 is filled with operating oil still.

During operation of the engine 1, the phase variable mechanism 30 is finely controlled by the oil pressure control valve 60 which acts corresponding to the engine operational condition. Therefore, the retard side control oil passage 70 and the advance side control oil passage 71 are scarcely closed for a long time. Accordingly, amount of operating oil flowing out through the minute gap when relative phase of the suction camshaft 10 is kept at a target phase is little compared with the amount of operating oil flowing out when the engine 1 is stopped, and also the flowing out of operating oil when a relative phase of the suction camshaft 10 is kept, can be dealt with by the above-mentioned set time.

It is desirable that the upper surfaces 72*a*, 73*a* of the operating oil reserve chambers 72, 73 are positioned higher than the uppermost position of the retard chamber 41 or the advance chamber 42 as far as the chambers 72, 73 are enclosed in the cylinder head cover 14, because the retard chamber 41 and the advance chamber 42, which are sometimes positioned higher than the oil passages 43, 44, can be maintained in a state that they are filled with operating oil during a long time when the engine 1 is stopped, so that the phase variable mechanism 30 can operate with no operation lag more frequently.

In the above-mentioned embodiment, when the engine 1 is stopped and therefore the oil pump 50 is stopped, volume of the retard chamber 41 is maximum while volume of the advance chamber 42 is substantially zero and the lock pin 37 is fitted in the lock hole 6*c* of the suction cam sprocket 6 to hold the phase variable mechanism 30 in the most retarded position. As for the oil pressure control valve 60, the spool 62 is forced by the spring 64 so that the inlet port 61*a* communicates with the retard port 61*b* and the advance port 61*c* communicates with the drain port 61*c*.

Now, suppose that a long time has elapsed after the engine 1 was stopped so that substantially no operating oil exists in the retard side control oil passage 70, the advance side control oil passage 71 and the advance chamber 42.

When this engine 1 of cold condition is started and becomes cranking state, the oil pump 50 is operated and delivered oil is sent to the oil pressure control valve 60 through the common supply oil passage 53 as operating oil.

On starting, since the target phase is set at zero, that is, the most retarded condition, the oil pressure control valve 60 maintains a state at a time when the engine is stopped in accordance with an instruction from the electronic control unit 59. At this time, the retard chamber 41 communicating with the inlet port 61*a* is filled with operating oil through the retard side control oil passage 70, and substantially at the same time, the retard side operating oil reserve chamber 72 is also filled with operating oil. On the one hand, substantially no operating oil exists in the advance chamber 42. And this state is maintained also when starting of the engine 1 has been completed and the engine becomes idling state.

When the engine 1 shifts to a loaded operation thereafter, duty ratio of the duty solenoid 63 is controlled by instructions from the electronic control unit 59 so that phase of the suction cam 8 becomes equal to a target phase set in accordance with the engine load and the engine rotational speed. Therefore, the spool 62 is moved so that the inlet port 61*a* communicates with the advance port 61*c*, the advance chamber 42 is filled with operation oil through the advance side control oil passage 71, and substantially at the same time, the advance side operating oil reserve chamber 73 is also filled with operating oil.

When oil pressure in the advance chamber 42 exceeds a predetermined value, the lock pin 37 is separated from the lock hole 6*c* by the oil pressure to enable the phase variable mechanism 30 to operate, and the suction camshaft 10 rotates relatively to the suction cam sprocket 6 to change phase of the suction camshaft 10 toward advance side. When a target phase is obtained, duty ratio of the duty solenoid 63 is set at 50% and spool 62 is positioned at the neutral position.

Then, duty ratio of the duty solenoid 63 is controlled by instructions from the electronic control unit 59 so that relative phase of the suction camshaft 10 becomes equal to a target phase set in accordance with an engine load and an engine rotational speed at that time. Accordingly, the spool 62 is moved right or left from the neutral position to control supply of operating oil to one of the retard side control oil passage 70 and the advance side control oil passage 71 and drainage of operating oil from another oil passage. Thus, oil pressure of the retard chamber 41 and the advance chamber 42 is controlled to change phase of the suction camshaft 10 continuously. When the target phase is obtained, duty ratio of the duty solenoid 63 is set at 50% to hold the spool 62 of the oil pressure control valve 60 at the neutral position, thus the control oil passage 55 composed of the retard side control oil passage 70 and the advance side control oil passage 71 is closed and relative phase of the suction camshaft 10 is held constant.

If the engine 1 is once stopped for idling stop or the like, the inlet port 61*a* communicates with the retard port 61*a* and the advance port 61*c* communicates with the drain port 61*e* in the oil pressure control valve 60, while the retard chamber 41 is filled with operating oil to the maximum volume and volume of the advance chamber 42 becomes zero in the phase variable mechanism 30. At this time, since also the oil pump 50 is stopped, operating oil is not supplied to the retard side control oil passage 70, the advance side control passage 71, the retard chamber 41 and the advance chamber 42. On the one hand, a little operating oil flows out through the minute gap formed among the cam journal 10*a*, the rocker shaft holder 19 and the cam holder 20.

However, because the retard side operating oil reserve chamber 72 is provided above the cam journal 10*a*, quantity of operating oil reserved above the minute gap is larger than that in the prior art. Therefore, a time required for operating oil in the retard chamber 41, the oil passage 43 and the oil passage 70*d* to decrease to the same degree as the prior art can be prolonged.

Therefore, when the engine 1 is started again, the retard chamber 41, the oil passage 43 and the oil passage 70*d* is filled with operating oil or more operating oil remains in the retard chamber 41, the oil passage 43 and the oil passage 72*d* compared with the prior art, so that operation lag of the phase variable mechanism 30 does not occur, or the suction valve 21 becomes a desired relative phase (a target phase) with relatively short operation lag time, to prevent lowering of output owing to operation lag of the phase variable mechanism 30.

As aforesaid, when the target phase is obtained, the spool 62 of the oil control valve 60 takes the neutral position to close the retard side control oil passage 70 and the advance side control oil passage 71 and hold the relative phase constant. Also in this case, the retard side control oil passage 70, the advance side control oil passage 71, the retard chamber 41 and the advance chamber 42 are not supplied with operating oil. At this time, owing to torque fluctuation of the suction camshaft 10 caused by forces given by the suction valve 21, the boss member 31 of the phase variable mechanism 30 compresses operating oil in the retard chamber 41 and the advance chamber 42 repeatedly, and a little operating oil flows out from the minute gap through the oil passages 43, 44 and the oil passages 70*c*, 70*d*, 71*c*, 71*d*.

Operating oil in the oil passages 43, 44 and the oil passages 70*c*, 70*d*, 71*c*, 71*d* is reduced gradually owing to flowing out of the operating oil through the above-mentioned minute gap, and at last, air is inhaled in the passages when the retard chamber 41 and the advance chamber 42 are expanded by the torque of the suction camshaft 10 based on forces given by the suction valve 21. However, because a large amount of operating oil is reserved in the retard side and advance side reserve chambers 72, 73 above the cam journal 10*a*, operating oil flowing out of the oil passages 43, 44 and the oil passages 70*c*, 70*d*, 71*c*, 71*d* is supplemented by the operating oil in the operating oil reserve chambers 72, 73. Accordingly, it takes much time for the air to be inhaled through the minute gap.

Thus, a possibility that air is inhaled in the oil passages 43, 44 and the oil passages 70*c*, 70*d*, 71*c*, 71*d* or the air further reaches the retard chamber 41 and the advance chamber 42 of the phase variable mechanism 30 while relative phase of the suction camshaft 10 is held to a target phase, can be lowered, so that a phenomenon that phase of the suction camshaft 10 deviates to the retard side and the advance side alternately synchronizing with the torque fluctuation of the suction camshaft 10 does not occur and fluctuation and lowering of the engine output can be prevented more frequently.

Since the operating oil reserve chambers 72, 73 can be provided utilizing the cam holder 20 disposed on an upper portion of the rocker shaft holder 19 for supporting the cam journal 10*a* from above, it is unnecessary to provide an additional member for forming the operating oil reserve chamber above the cam journal 10*a*, and the operating oil reserve chambers 72, 73 can be provided easily in a customary internal combustion engine with a phase variable mechanism only by changing the cam holder without changing arrangement of members around the suction and exhaust camshafts.

Since the oil passages 70*d*, 71*d* constituting the retard side and advance side control oil passages 70, 71 are provided in the cam holder, the operating oil reserve chambers 72, 73 can be connected with the retard side and advance side control oil passages 70, 71 by connecting the operating oil reserve chambers 72, 73 with the oil passages 70*d*, 71*d* within the cam holder 20, without necessitating additional connecting passages, compactly and easily.

Since the operating oil reserve chambers 72, 73 and the oil passages 70*d*, 71*d* can be formed concurrently with casting of the cam holder 20, the working man-hour and the cost can be reduced. Further, the operating oil reserve chambers 72, 73 are formed as deep cuts including the oil passages 70*d*, 71*d* integrally, no construction for connecting the operating oil reserve chambers 72, 73 with the oil passages 70*d*, 71*d* is necessary to facilitate formation of the operating oil reserve chambers 72, 73 and the oil passages 70*d*, 71*d*.

In the above-mentioned embodiment, the phase variable mechanism 30 is provided on the suction camshaft 10 only. But the phase variable mechanism 30 may be provided on the exhaust camshaft 11 only or may be provided on both the suction camshaft 10 and the exhaust camshaft 11. Further, the support member composed of the cam holder 20 and the rocker shaft holder 19 may be composed of the cam holder and the cylinder head.

Though semi-annular oil passages 70*d*, 71*d* to be formed in the cam holder 20 are formed by deep cuts integral with the retard side and advance side operating oil reserve chambers 72, 73 in the above embodiment, the operating oil reserve chambers and the oil passages may be formed separately with each other and communication passages connecting them may be formed in the cam holder.

In place of the phase variable mechanism 30 changing relative phase of the suction camshaft 10 to the crankshaft 2 according to the above embodiment, a phase variable mechanism, in which the suction cam or the exhaust cam is provided so as to rotate relatively to the camshaft and the cam is rotated by oil pressure to change relative phase of the suction valve or the exhaust valve to the crankshaft 2, can be used.

In the above embodiment, the oil passages 70*c*, 70*d* of the retard side control oil passage 70 and the oil passages 71*c*, 71*d* of the advance side control oil passage 71 are formed in the rocker shaft holder 19 and the cam holder 20. But the oil passages may be formed on the cam journal 10*a*.

What is claimed is:

1. A valve movement control system of an internal combustion engine, comprising a camshaft driven by a crankshaft having a cam journal supported for rotation by a support member; a hydraulic operational characteristic variable mechanism provided on said camshaft for altering operational characteristic of an engine valve driven by a cam of said camshaft; an operating oil passage extending from an oil pressure supply source driven by the internal combustion engine to said operational characteristic variable mechanism passing through a plurality of members including at least said camshaft and said support member; and an oil pressure control valve provided in said operating oil passage for controlling pressure of operating oil sent to said operating characteristic variable mechanism, said operating oil passage forming a control oil passage having a first oil passage and a second oil passage between an operation chamber of said operational characteristic variable mechanism and said oil pressure control valve, said first oil passage provided in said camshaft having an end communicating with said operation chamber and another end communicating with said second oil passage formed between said cam journal and said support member, wherein an operating oil reserve chamber communicating with said control oil passage is provided above said cam journal.

2. A valve movement control system of an internal combustion engine as claimed in claim 1, wherein said support member comprises a lower member and a cam holder disposed above said lower member, and said operating oil reserve chamber is provided in said cam holder and communicates with said second oil passage within said cam holder.

* * * * *